United States Patent [19]

Larsson

[11] 4,325,464

[45] Apr. 20, 1982

[54] LIFTING STAND OF A MOTOR-DRIVEN TRUCK

[75] Inventor: Nils-Olof Larsson, Halmstad, Sweden

[73] Assignee: Kalmar Last Maskin Verkstad AB, Sweden

[21] Appl. No.: 101,090

[22] Filed: Dec. 7, 1979

[30] Foreign Application Priority Data

Mar. 9, 1979 [SE] Sweden ..... 7907303

[51] Int. Cl.[3] ..... B66B 9/20

[52] U.S. Cl. ..... 187/9 E; 92/137; 414/631

[58] Field of Search ..... 187/9 E, 9 R, 17; 254/4 R, 4 B, 89 H; 92/66, 137; 91/167; 414/629, 630, 631

[56] References Cited

U.S. PATENT DOCUMENTS

| | | | |
|---|---|---|---|
| 1,834,701 | 12/1931 | Gustafson | 92/137 |
| 2,399,632 | 5/1946 | Guerin | 187/9 E |
| 2,840,347 | 6/1958 | Feucht | 92/137 |
| 3,127,956 | 4/1964 | Hosbein et al. | 187/9 E |
| 3,394,778 | 7/1968 | Brinton | 187/9 E |
| 3,477,229 | 11/1969 | Katko | 91/167 R |
| 3,534,664 | 10/1970 | Ulinski | 187/9 E |
| 4,030,568 | 6/1977 | Heinold | 187/9 E |

*Primary Examiner*—David A. Scherbel
*Assistant Examiner*—Kenneth Noland
*Attorney, Agent, or Firm*—Lerner, David, Littenberg & Samuel

[57] ABSTRACT

A lifting stand of a motor-driven truck. The lifting stand being telescopically extensible and comprising an outer frame attached to the truck and an inner frame displaceable between a lower retracted position and an upper projecting position. The inner frame supports a lifting carriage provided with a fork and displaceably mounted to the inner frame for movement along this. The lifting carriage is arranged to be moved along the inner frame by way of specially arranged hydraulic cylinders while the inner frame remains immobile in relation to the outer frame and good visibility is maintained through the lifting stand.

4 Claims, 6 Drawing Figures

LIFTING STAND OF A MOTOR-DRIVEN TRUCK

BACKGROUND OF THE INVENTION

The present invention relates to an improvement in a motor-driven truck having a mastlike, telescopically extensible lifting stand comprising an outer frame attached to the truck and an inner frame displaceable between a lower retracted position and an upper projecting position, said inner frame being provided with a lifting carriage having load-carrying means and being movable along the inner frame.

Already known constructions of fork trucks or trucks with other load-carrying means of the type described above have been unable simultaneously to solve the problem of achieving what is known as free-lift technique, the object of which is to obtain lifting ability without the working height of the truck being increased, and the problem of achieving good visibility for the truck driver through the lifting stand, particularly in connection with trucks dimensioned for high work capacities.

The above problems are solved by means of the present invention which also results in the important advantage that trucks can now be made with higher and in fact even considerably higher work capacities than has so far been possible, such as trucks with a lifting ability of up to 60 tons.

SUMMARY OF THE INVENTION

The primary novelty of the invention resides in the improvement that the lifting carriage is arranged to be moved along the inner frame by means of force-transmitting means while the inner frame remains immobile in relation to the outer frame and that the force-transmitting means are arranged so that good visibility is maintained through the lifting stand.

According to a particularly preferred embodiment of the invention the force-transmitting means comprise an outer pair of hydraulic cylinders attached to the lifting carriage at one end and an inner pair of hydraulic cylinders attached to lower portions of the inner frame by one end, the inner and outer hydraulic cylinders being joined together by their other ends via two chains or the like running over pulleys journalled in upper portions of the inner frame.

The invention will be described in the following with reference to the drawings in which.

Figure 1:
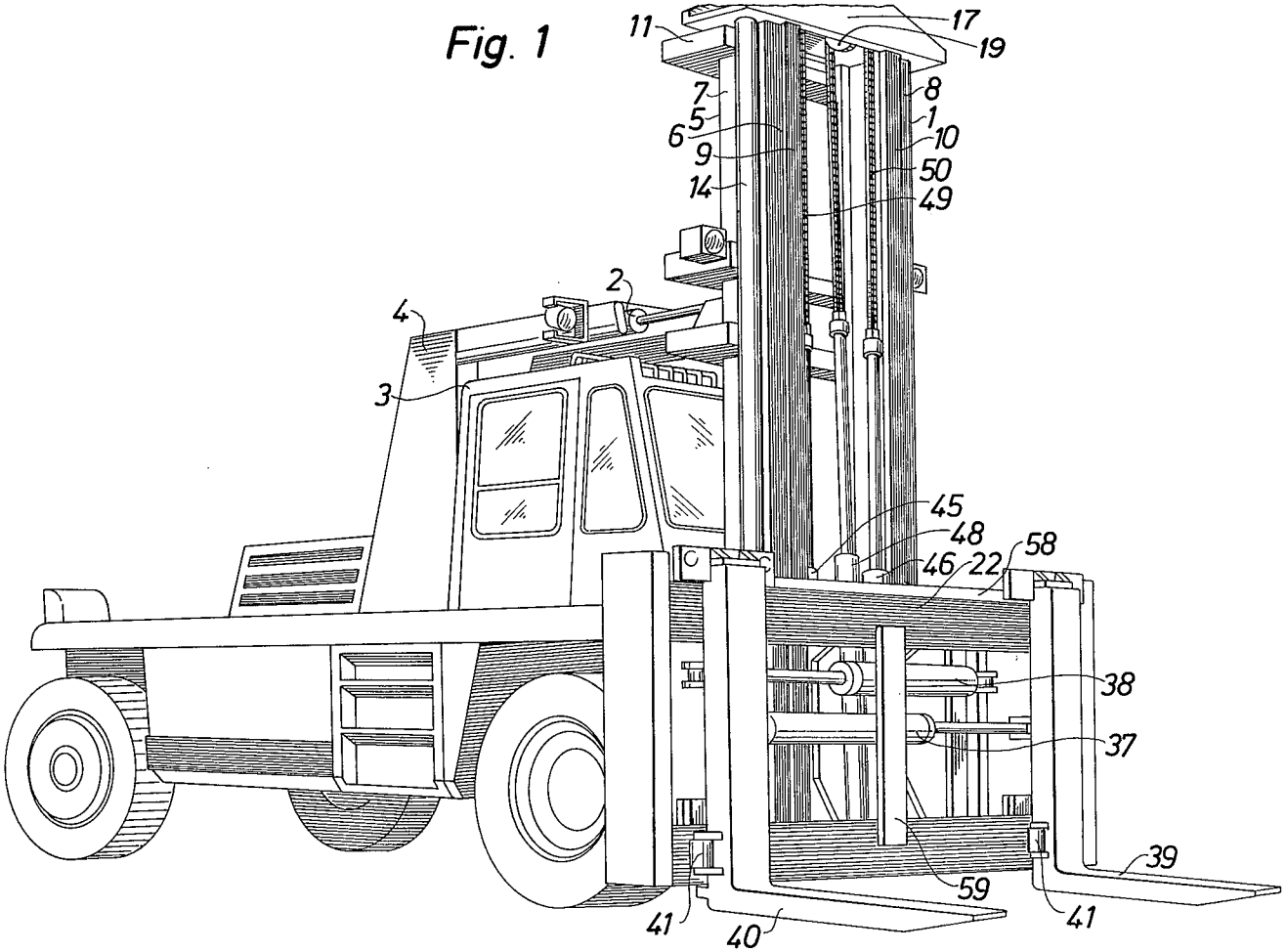
FIG. 1 shows in perspective a motor-driven fork truck with a lifting stand constructed in accordance with the present invention.

Referring to FIG. 1, a motor-driven fork truck is shown therein which has at its front end a vertical or mastlike lifting stand 1 which, in known manner, is pivotable at the frame 51 of the fork truck about horizontal journalling pins 52 (see FIG. 3) and can be swung by means of two tipping cylinders 2 which are secured to the lifting stand and located above the driver's cab 3 and attached to a support construction 4 behind or obliquely behind the driver's cab. The tipping cylinders permit the desired, controlled inclination of the lifting stand 1 forwards and backwards. The inclination of the lifting stand forwards is preferably 5° and backwards 12°.

In the embodiment shown the lifting stand comprises an outer frame 5 and an inner frame 6, each comprising two vertical U-section girders 7, 8 and 9, 10, respectively, arranged parallel to and spaced from each other. The U-section girders of the outer frame are connected by an upper cross-beam 11, a lower cross-piece 12 and two intermediate cross-beams 53, 54, the lower of which is provided with lugs 13 for attachment of said tipping cylinders 2. The intermediate cross-beams 53, 54 and the upper cross-beam are located behind the space in which the inner frame 6 is located and shall move. The inner frame 6 is slidable in the outer frame 5 and is guided therein by means of a number of guide wheels mounted in pairs on the outside of the vertical U-section girders 9, 10 of the inner frame and running in the channels facing each other of the vertical U-section girders 7, 8 of the outer frame, said channels facing each other. The inner frame 6 is arranged to be raised and lowered in relation to the outer frame 5 by the controlled operation of two hydraulic cylinders 14 extending along the outside of the vertical U-section girders 7, 8 of the outer frame and secured to lower brackets 15 protruding from the sides of these U-section girders. The opposite ends, i.e. the piston rods 16 (see FIG. 6), of the hydraulic cylinders 14 are secured to the lower side of an upper cross-beam 17 connecting the upper ends of the vertical U-section girders 9, 10 of the inner frame.

The stroke length of the hydraulic cylinders 14 is sufficient to enable the inner frame 6 to be lifted as high as possible in the outer frame without loss of control or stability.

The cross-beam 17 of the inner frame 6 also provides a journalling point for two pulleys or chain wheels 18, 19. spaced from each other, the chain tracks of which are located within the extension of the U-section girders 9, 10.

Furthermore, the lower ends of the U-section girders 9, 10 of the inner frame 6 are connected together by a crosspiece 20 provided with two pairs of upwardly directed lugs forming the cylinder attachment 21 which is arranged in line with said chain wheels 18, 19 in the upper cross-beam 17. Their function will be described below.

The lifting stand also includes a lifting or fork carriage 22 which is arranged to be carried by the inner frame 6 and is guided by this during its movement along the inner and outer frames. The fork carriage comprises a rectangular frame consisting of two horizontal beams 24, 25 and two vertical flat bars 26, 27 connecting the beams, as well as a vertical central support 59 which has been omitted in FIG. 2 for the sake of clarity. Two vertical bearing plates 28, 29 are welded to the horizontal beams at equal and predetermined distance from the centre of the fork carriage and extend from the fork carriage perpendicularly backwards to assume, without friction, a position in the vicinity of the inner sides of the U-section girders 9, 10 of the inner frame 6. The sides of the two bearing plates 28, 29 facing away from each other are provided with two guide wheels 30, 31 arranged to be received and run in the opposing channels 55, 56 of the vertical U-section girders 9, 10 of the inner frame. These guide wheels 30, 31 are substantially similar to those described eariler for journalling the inner frame to the outer frame. In both these arrangements a number of support rollers 57 are preferably used on the inner frame 6 (not shown) and on the bearing plates 28, 29, the central axes of said rollers being perpendicular to the central axes of the guide wheels 30, 31. The support rollers 57 are arranged to run against the bottom surfaces of the channels of the U-section girders of the outer and inner frames, respectively, so that the movable parts of the construction are stabilized laterally as well as the vertical movement per se being facilitated.

Between the two vertical bearing plates 28, 29 and in line with the lower cylinder attachments 21 on the inner frame 6, and thus also in line with the chain wheels 18, 19, there are two pairs of upwardly directed lugs which form the cylinder attachment 32 welded to the inside of the lower horizontal beam 25 of the fork carriage. The function of this will be described below.

Between each bearing plate 28, 29 and the adjacent vertical flat bar 26, 27 extends an angle piece 33, 34. These angle pieces are welded to the horizontal beams 24, 25 of the fork carriage and are provided with lugs facing each other and arranged at different levels to form the cylinder attachments 35, 36 for two horizontal hydraulic cylinders 37, 38, the pistons of which are attached one to each of the forks 39, 40, i.e. in each case to the fork located furthest away. Each fork is provided with lower journalling members comprising a pair of support rollers 41 mounted to roll on the outside of a lower horizontal beam 25, and an inner support element 42 giving support behind an upper edge of the beam 25 to keep the fork in position close to the carriage 22, as well as upper journalling members comprising a pair of horizontally journalled rollers 43 and a pair of vertically journalled rollers 44. Said rollers 43 and 44 rotate on and behind a square strip 58 which is welded to the upper horizontal beam 24. The forks 39, 40 are thus slidably journalled on the carriage 22 and can be moved sideways individually in desired direction. This movement is taken care of by respective hydraulic cylinders 37, 38 which can thus be operated individually to set the desired working space between the points of the forks and also simultaneously to place the forks in any desired position along the carriage 22 such as an inner position for one fork and an outer or intermediate position for the other fork.

The fork carriage 22 is operated by special force-transmitting means which in the embodiment shown comprise a first or outer pair of hydraulic cylinders 45, 46 and a second or inner pair of hydraulic cylinders 47, 48. The piston rods 45*a*, 47*a* and 46*a*, 48*a*, arranged close together in pairs are connected to each other by a chain 49, 50 for each of said pairs, these chains passing around said chain wheels 18, 19 which are journalled at the upper cross-beam 17 of the inner frame. The pistons of the outer hydraulic cylinder 45, 46 are secured to said cylinder attachments 32 of the fork carriage 22, while the pistons 47, 48 of the inner hydraulic cylinders are secured to said cylinder attachments 21 of the inner frame 6.

The hydraulic cylinders described are single acting. The supply and return communications, such as tubes, to the various hydraulic cylinders have been omitted for the sake of clarity but are placed so that the space between the vertical U-section girders 9, 10 of the inner frame 6 is not occupied. These feeding tubes can preferably be placed along one side of the outer frame so as to occupy the driver's field of vision as little as possible. The various hydraulic functions can be conveniently operated from the driver's cab.

Figure 3:
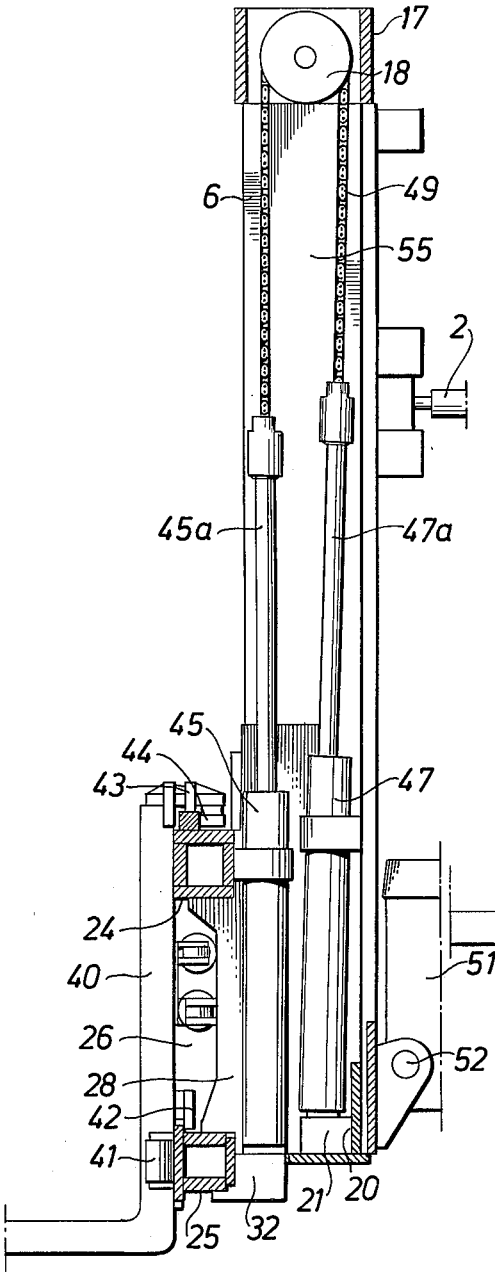
FIGS. 3–6 show in vertical, central section through the lifting stand according to FIG. 1, the structure of the force-transmitting means including that for lifting the inner frame.
Figure 4:
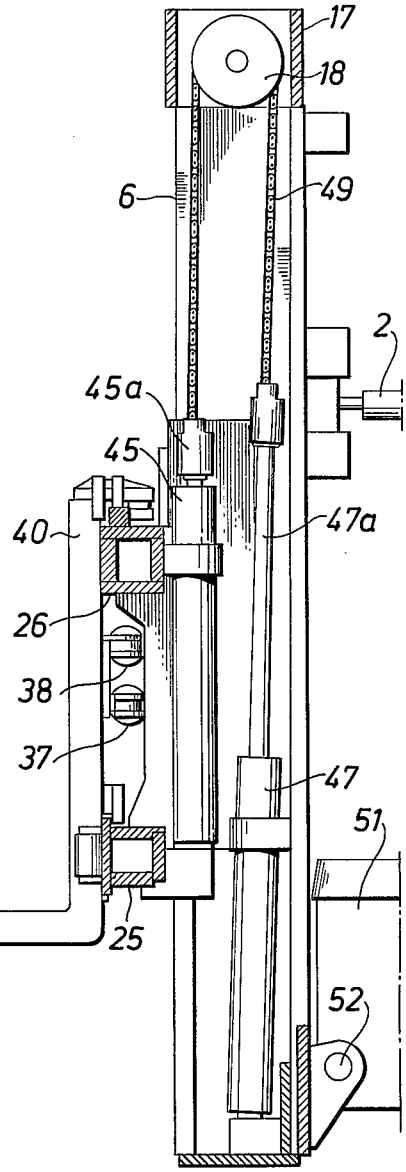
Figure 5:
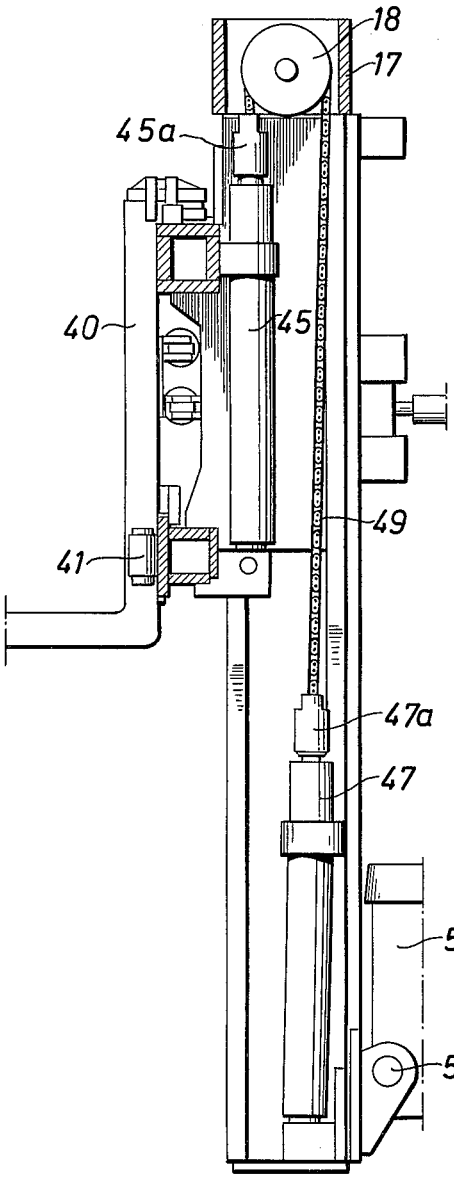
Figure 6:
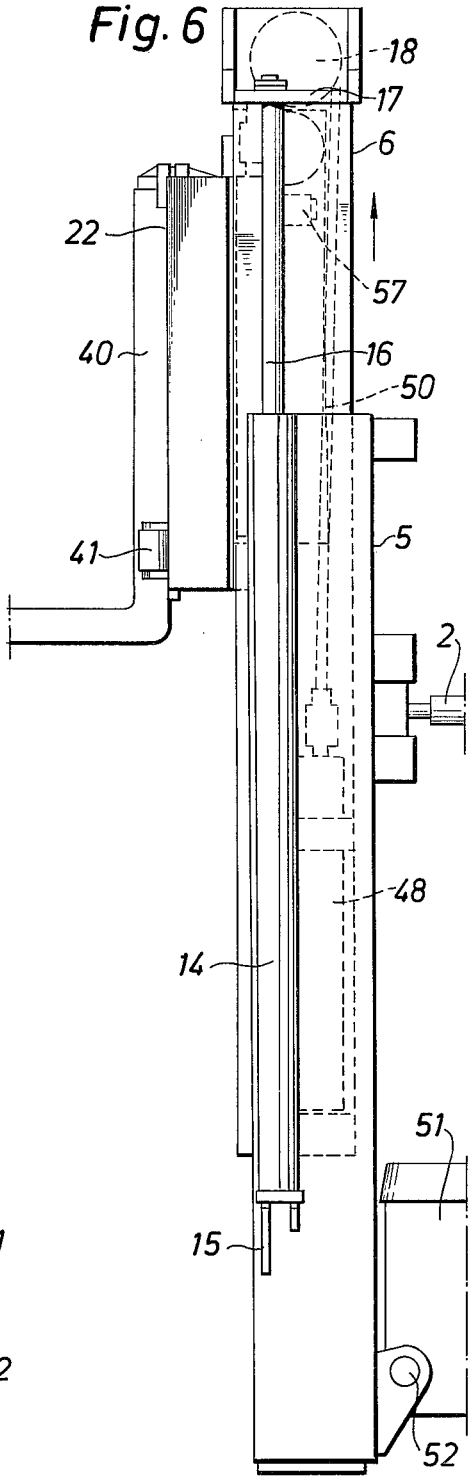

The functions of the fork carriage 22 and its movement in relation to the inner frame are illustrated in FIGS. 3–5. FIG. 3 shows the initial position of the fork carriage when in its lowest position on the lifting stand 1. In this position both the outer and the inner hydraulic cylinders 45, 46 and 47, 48, respectively, have their piston rods in extended position. If it is assumed that pressure medium is supplied to the two pairs of hydraulic cylinders in such a way that the outer cylinders are placed under pressure first, the rods 45*a*, 46*a* of the outer hydraulic cylinders will first be forced (though the rods are stationary in relation to the frame 6) into the relevant piston with the result that these pistons will be lifted simultaneously with the fork carriage 22 since the pistons are attached thereto. FIG. 4 shows the situation when the full stroke length for the outer hydraulic cylinders 45, 46 is used. The pressure will thereafter be exerted on the inner hydraulic cylinders 47, 48 so that their piston rods 47*a*, 48*a* are pushed into the relevant piston. Since these inner pistons are attached to the inner frame 6 there will be a pulling force in the chains 49, 50 running over the chain wheels 18, 19 and the outer hydraulic cylinders 45, 46 and fork carriage 22 will consequently be lifted further to the highest position in relation to the inner frame 6 when the stroke length of the piston rods 47*a*, 48*a*, in question has been fully utilized as illustrated in FIG. 5. The fork carriage can then be lifted even further by means of the hydraulic cylinders 14 arranged at the sides of the lifting stand, which lift the inner frame 6, fork carriage 22 and its control means 45, 46, 47, 48 as a unit upwardly out of the outer frame 5 as illustrated in FIG. 6 and indicated by an arrow. If desired the operation can be adapted so that it is possible to lower or, if this is possible, to additionally lift the lifting carriage in relation to the inner frame by means of the inner and outer hydraulic cylinders 45, 46, 47, 48 even when the inner frame is in raised position in relation to the outer frame.

Figure 2:
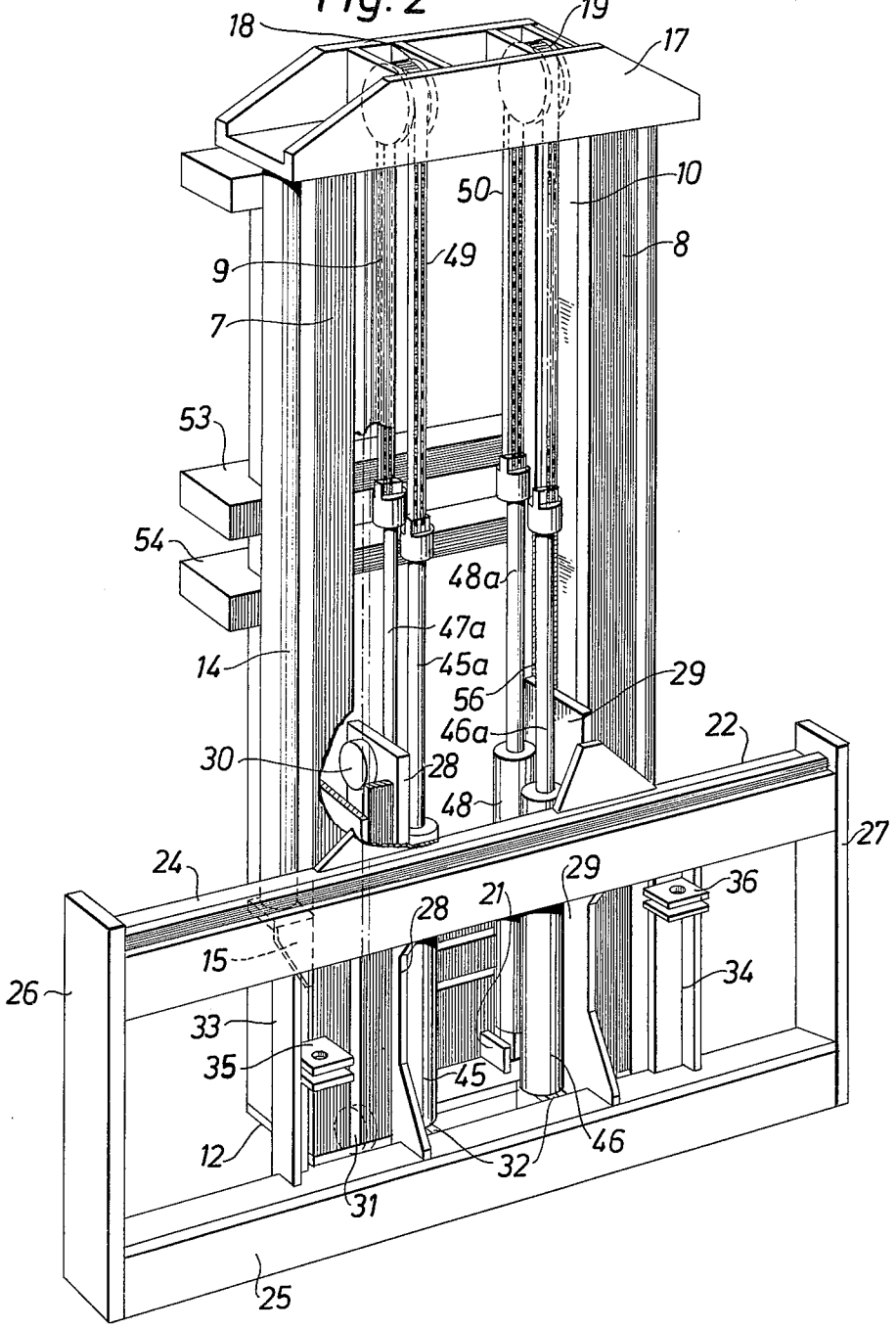
FIG. 2 shows in perspective the lifting stand and parts of its lifting carriage partly in section.

The arrangement described offers what is known as a free-lift stand which means that the lifting carriage can be moved to its top position (FIG. 5) before starting to raise the inner frame (FIG. 6). This means that the working height of the truck is kept low during half the total lifting height of the truck since the fork carriage can be raised initially without lifting the inner frame 6 above the outer frame 5. The arrangement also permits extremely good visibility through the lifting stand, as desired, as can be seen in FIGS. 1 and 2, since the hydraulic cylinders 45, 46, 47, 48 do not noticeably block the view through the lifting stand 1 as they can be made with relatively small dimensions. The combination of free-lift technique and good visibility through the lifting stand has not been proposed before and offers obvious advantages and features which have long been desired.

The invention is not limited to the embodiment described above but can be varied and modified in many ways within the scope of the following claims. For example, the force-transmitting means for operating the lifting carriage may consist of only one (especially in small trucks) or one pair of hydraulic cylinders, i.e. the inner hydraulic cylinders may be omitted, likewise the chains and chain wheels, in which case the hydraulic cylinders according to this alternative are attached to the lifting carriage in the same way as described but are attached by their piston rods to the upper part of the inner frame. This embodiment is therefore cheaper to manufacture but the free-lift capacity, i.e. the lifting height of the carriage in relation to the inner frame will be somewhat lower unless telescopic hydraulic cylinders are used. In all cases it is desirable to place the hydraulic cylinders for the lifting carriage as far from the vertical centre line of the lifting stand as possible. This gives a wide space inside the inner frame between the hydraulic cylinders which is free from construction elements.

The lifting carriage may be equipped with or be designed to be equipped with load-carrying means other than forks, such as a timber grab, i.e. a jawlike implement. Furthermore, the lifting stand may include one or more additional frames which can be individually operated and lifted in the same way as the inner frame, but initially together with this. Such additional frames should be placed between the outer and inner frames and having substantially the same construction as the inner frame as well as their own hydraulic cylinders to lift them and the inner frame or frames.

I claim:

1. A telescopically extensible lifting stand of a motor-driven truck comprising an outer frame attached to the truck and an inner frame displaceable between a lower retracted position and an upper projecting position, said inner frame carrying a lifting carriage provided with load-carrying means and displaceably journalled on the inner frame for movement along said frame, said lifting carriage being arranged to be moved along the inner frame by means of force-transmitting means while the inner frame remains immobile in relation to the outer frame, said force-transmitting means comprising an outer pair of hydraulic cylinders attached at one end to the lifting carriage and an inner pair of hydraulic cylinders attached at one end to lower portions of the inner frame, said inner and outer hydraulic cylinders being operatively joined in pairs at their outer ends by chains extending over pulleys journalled at upper portions of the inner frame.

2. The lifting stand according to claim 1 wherein said inner and outer hydraulic cylinders are arranged within said inner frame such that visibility through the lifting stand is maintained.

3. The lifting stand according to claim 1 further including at least one intermediate frame displaceably journalled in the outer frame in its longitudinally direction with respect to the inner frame.

4. The lifting stand according to claims 1, 2 and 3, wherein said inner frame is arranged to be moved in longitudinal direction by means of two hydraulic cylinders arranged one on each side of said outer frame and attached to lower portions of the outer frame at their lower ends and to upper portions of the inner frame at their upper ends.

* * * * *

UNITED STATES PATENT AND TRADEMARK OFFICE

CERTIFICATE OF CORRECTION

PATENT NO. : 4,325,464

DATED : April 20, 1982

INVENTOR(S) : Nils-Olof Larsson

It is certified that error appears in the above-identified patent and that said Letters Patent are hereby corrected as shown below:

Column 6, line 8, "outer" should read --other--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*